US010913554B2

(12) United States Patent
Rea et al.

(10) Patent No.: US 10,913,554 B2
(45) Date of Patent: Feb. 9, 2021

(54) UNIT AND METHOD FOR RELEASING PRODUCT FOR EXTRACTION OR INFUSION BEVERAGES IN CONTAINERS FORMING SINGLE-USE CAPSULES OR PODS

(71) Applicant: GIMA S.p.A., Zola Predosa (IT)

(72) Inventors: Dario Rea, Monterenzio (IT); Pierluigi Castellari, Castel San Pietro Terme (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 516 days.

(21) Appl. No.: 15/116,688

(22) PCT Filed: Feb. 3, 2015

(86) PCT No.: PCT/IB2015/050820
§ 371 (c)(1),
(2) Date: Aug. 4, 2016

(87) PCT Pub. No.: WO2015/118450
PCT Pub. Date: Aug. 13, 2015

(65) Prior Publication Data
US 2016/0347483 A1 Dec. 1, 2016

(30) Foreign Application Priority Data
Feb. 6, 2014 (IT) ..... BO2014A0053

(51) Int. Cl.
*B65B 1/04* (2006.01)
*B65B 1/36* (2006.01)
*B65B 29/02* (2006.01)

(52) U.S. Cl.
CPC ..... *B65B 1/04* (2013.01); *B65B 1/36* (2013.01); *B65B 29/022* (2017.08)

(58) Field of Classification Search
CPC .... B65B 1/00; B65B 1/04; B65B 1/12; B65B 1/24; B65B 1/36; B65B 1/363;
(Continued)

(56) References Cited

U.S. PATENT DOCUMENTS 2,567,052 A * 9/1951 Carruthers ..... B65B 63/022 100/178
3,552,454 A * 1/1971 Deming, Sr. ..... B65B 1/24 141/71
(Continued)

FOREIGN PATENT DOCUMENTS

WO WO 01/34475 A1 5/2001
WO WO 2005/012100 A1 2/2005
(Continued)

OTHER PUBLICATIONS

International Search Report and Written Opinion for corresponding Patent Application No. PCT/IB2015/050820 dated Apr. 22, 2015.
(Continued)

*Primary Examiner* — Anna K Kinsaul
*Assistant Examiner* — Daniel Jeremy Leeds
(74) *Attorney, Agent, or Firm* — Renner, Otto, Boisselle & Sklar, LLP

(57) ABSTRACT

Described is a unit for releasing product for extraction or infusion beverages in containers (2) forming single-use capsules (3) comprising: at least one seat (S1) for containing a predetermined dose (33) of product having side walls; a device (6) for feeding the product in the containing seat (S1) to define the dose (33); a device (70) for compressing the product in the containing seat (S1); a device (10) for moving the seat (S1) along a closed path (PS); a device (71) for ejecting the dose from the containing seat (S1); a unit (15) for controlling and operating the compacting device (70) and the ejection device (71); the control and operating unit (15)
(Continued)

being configured for controlling the compacting device (70) with a force such as to produce a compression which causes a coupling of the dose (33) with the side walls of the containing seat (S1) which prevents, in the operating condition of the unit, the escape of the dose from the containing seat (S1) in the absence of actions mechanical for pushing on the dose.

22 Claims, 7 Drawing Sheets

(58) Field of Classification Search
CPC ..... B65B 1/38; B65B 1/385; B65B 29/02; B65B 29/022; B65B 63/02; B65B 63/022; B07C 5/00
See application file for complete search history.

(56) References Cited

U.S. PATENT DOCUMENTS 3,565,132 A * 2/1971 Lefort ..... B65B 1/38 141/147
3,578,778 A * 5/1971 Matthews ..... B65B 1/366 141/144
3,718,164 A * 2/1973 Stewart ..... B65B 1/36 141/1
3,893,492 A * 7/1975 Nohren ..... B65B 1/24 141/1
3,923,084 A * 12/1975 Matthews ..... B65B 9/087 141/144
4,154,045 A * 5/1979 Christensson ..... B65B 1/22 53/432
4,330,252 A * 5/1982 Bullock ..... B65B 63/022 100/265
4,731,979 A * 3/1988 Yamamoto ..... A61J 3/074 53/281
5,174,088 A * 12/1992 Focke ..... B65B 1/38 53/111 R
5,549,144 A * 8/1996 Dworak ..... B65B 1/24 141/10
5,649,412 A * 7/1997 Binacchi ..... B65B 9/023 426/77
5,653,092 A * 8/1997 Gorby ..... B65B 3/32 100/178
5,694,741 A * 12/1997 Weder ..... B65B 1/363 53/253
8,122,893 B2 * 2/2012 Boldrini ..... B65B 1/363 131/112
9,169,082 B2 * 10/2015 Kerschbaumer ..... B65B 1/38
2005/0115309 A1 * 6/2005 Platon ..... A01F 15/08 73/73
2006/0207619 A1 * 9/2006 Conti ..... B65B 1/366 131/322
2006/0260274 A1 * 11/2006 Rea ..... B65B 1/385 53/122
2006/0292320 A1 * 12/2006 Greenwood ..... B29C 65/18 428/34.1
2007/0180794 A1 * 8/2007 Paunesku ..... B65B 9/087 53/455
2009/0095165 A1 * 4/2009 Nosler ..... A47J 31/007 99/289 R
2012/0190521 A1 * 7/2012 Rivera ..... B31D 5/0082 493/58
2013/0108752 A1 * 5/2013 Kollep ..... B30B 11/08 426/394
2013/0125508 A1 * 5/2013 Honda ..... B65B 1/04 53/268
2013/0168416 A1 * 7/2013 Librio ..... B65B 1/366 222/218
2014/0027011 A1 * 1/2014 Bahr ..... A01C 1/00 141/9
2014/0352254 A1 * 12/2014 Rea ..... B65B 1/46 53/167
2015/0143779 A1 * 5/2015 Yamauchi ..... B65B 29/02 53/429
2015/0225099 A1 * 8/2015 Villain ..... B65B 29/02 426/115
2015/0291347 A1 * 10/2015 Rivola ..... B65B 29/02 426/77
2016/0229570 A1 * 8/2016 Rea ..... B65B 29/02
2016/0347484 A1 * 12/2016 Rea ..... B65B 29/02
2017/0203864 A1 * 7/2017 Rea ..... B65B 29/02
2018/0178935 A1 * 6/2018 Baraccani ..... B65B 1/24
2018/0178936 A1 * 6/2018 Castellari ..... B65B 29/02

FOREIGN PATENT DOCUMENTS

WO WO 2008/129350 A1 10/2008
WO WO 2013/144837 A1 10/2013

OTHER PUBLICATIONS

Search Report for corresponding Italian Patent Application No. ITBO20140053 dated Oct. 7, 2014.

* cited by examiner

UNIT AND METHOD FOR RELEASING PRODUCT FOR EXTRACTION OR INFUSION BEVERAGES IN CONTAINERS FORMING SINGLE-USE CAPSULES OR PODS

This application is a national phase of International Application No. PCT/IB2015/050820 filed Feb. 2, 2015 and published in the English language, which claims priority to Italian Patent Application No. BO2014A000053 filed Feb. 6, 2014, which are hereby incorporated herein by reference in their entirety.

TECHNICAL FIELD

This invention relates to a unit for releasing product and a release method for releasing the product in containers forming single-use capsules or pods.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

In the technical sector in question, there is prior art machinery for the filling of rigid, cup-shaped containers.

Such machines are equipped with a unit for releasing product in the rigid, cup-shaped containers, which is usually equipped with a plurality of containing seats inside of which a suitable feed device releases a predetermined quantity of product.

The product or dose inside a containing seat is released inside a rigid, cup-shaped container.

It should be noted that a strongly felt-need in these machines is to prevent the accidental escape of the product from the filled containing seat, that is to say, to prevent the product from escaping from the containing seat in a region when no release is planned, because the rigid, cup-shaped container is not present, or it is still not correctly positioned relative to the containing seat.

Another strongly felt need in these machines is to prevent the accidental escape of the product from the rigid, cup-shaped container, for example due to turbulence generated by the product falling (by gravity) at high speed from the containing seat towards the rigid, cup-shaped container.

This release, that is to say, the accidental escape, means that the cup-shaped containers might only be partly filled, with the waste of product (that is, more generally, a poor dosing accuracy is complained about), or the product also settles on the neck of the rigid container, thus adversely affecting the subsequent step of sealing the length of sealing sheet to the neck. Further, if the product is dosed outside the rigid container, it creates an unwanted build-up of product in the machine which must necessarily be removed by stopping the machine.

Moreover, the overall reliability of the machine is compromised by the unwanted release of product, because the product released in unwanted positions can come into contact with moving elements or parts of the machine which can be damaged.

Another type of machine provides for the release of the product above a strip of filter material (for example, paper-based material) which defines portions of a single-use pod.

Also in this type of machine there are the problems of accidental release of the product highlighted above with regard to the cup-shaped containers, with the consequent presence of product in zones of the strip of filter material subject to subsequent sealing.

A strongly felt need by operators in this sector is therefore that of having a release unit and a method for releasing product for extraction or infusion beverages in containers (rigid, cup-shaped containers, or filtration elements) forming single-use capsules, or pods, which prevent accidental release of the product.

AIM OF THE INVENTION

Further, one aim of this invention is to provide a unit for releasing product for extraction or infusion beverages and a method for releasing the above-mentioned product which allows a high operational reliability to be maintained, extending the useful life of the packing machine.

Another aim of this invention is to provide a unit for releasing product for extraction or infusion beverages and a method for releasing the above-mentioned product which are particularly simple, reliable and inexpensive and at the same time maintain a high overall productivity.

Another aim of this invention is to provide a unit for releasing product for extraction or infusion beverages and a method for releasing the above-mentioned product which allows single-use capsules, or pods, to be made containing high quality infusion or extraction products.

The aim of this invention is to satisfy the above-mentioned need and to overcome the above-mentioned drawbacks, by providing a unit and a method for releasing product for extraction or infusion beverages in containers (rigid, cup-shaped containers or filter elements) forming single-use capsules, or pods, which prevent the accidental release of the product.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiments of the invention provided merely by way of example without restricting the scope of the inventive concept, and in which

DETAILED DESCRIPTION OF PREFERRED EMBODIMENTS OF THE INVENTION

With reference to the accompanying drawings, the numeral 1 denotes a unit for releasing infusion or extraction product in containers 2 forming single-use capsules 3 or pods for extraction or infusion beverages.

The product is preferably a solid product in powder, granules or leaves, such as coffee, tea, camomile, milk, chocolate, or combinations of these.

The release unit 1 is particularly suitable for filling containers 2 forming single-use capsules 3 with products in powder, preferably coffee.

Figure 1:
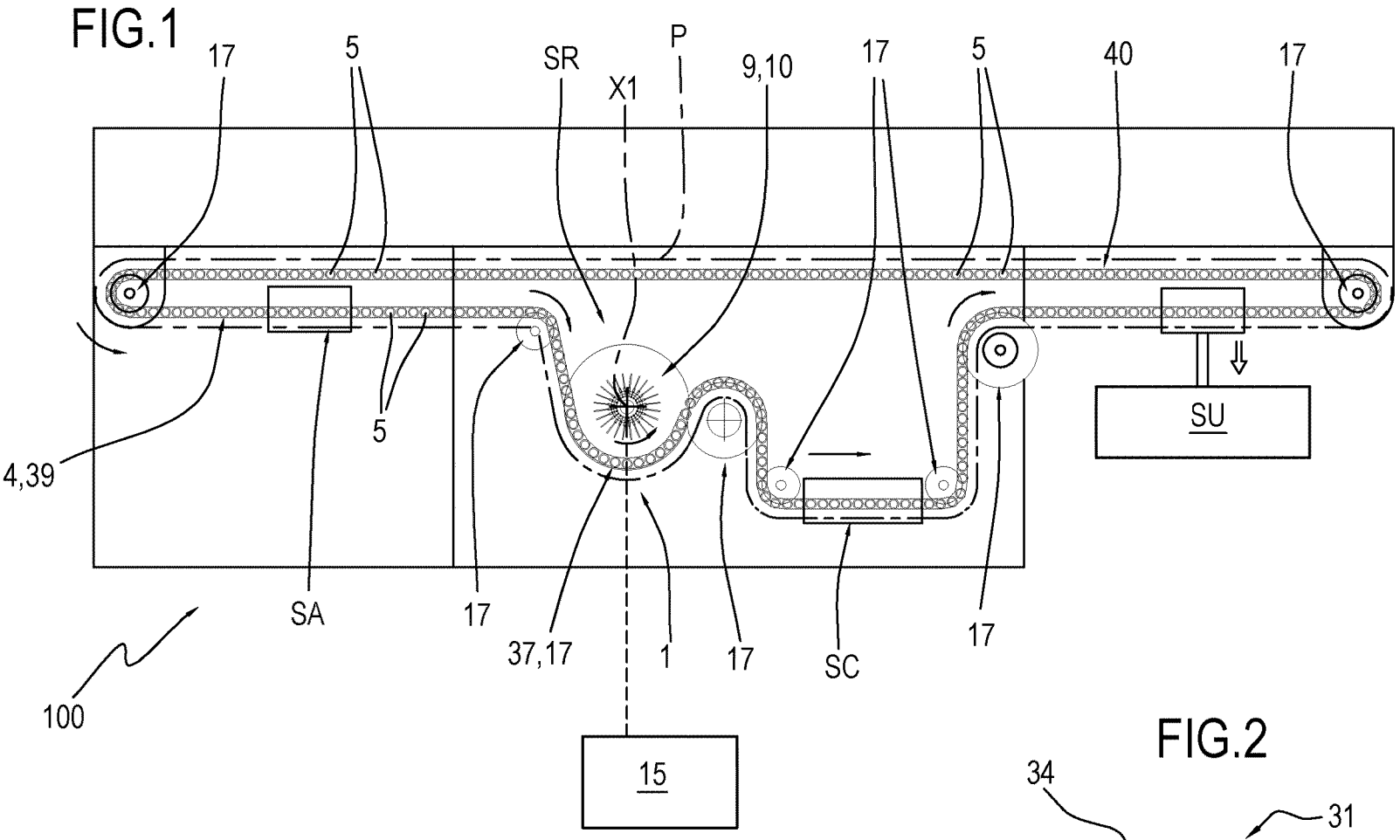
FIG. 1 is a schematic view of a machine for packaging containers forming single-use capsules for extraction or infusion beverages comprising a release unit according to a preferred embodiment of the invention.
Figure 2:
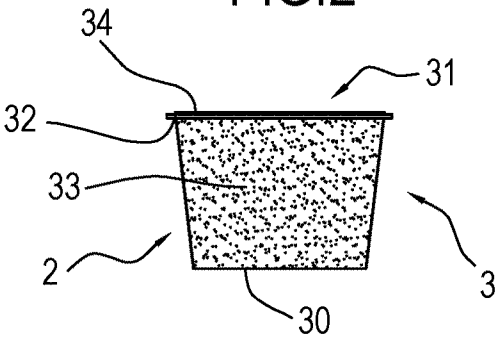
FIG. 2 is a schematic view of a single-use capsule for extraction or infusion beverages which can be made by the machine of FIG. 1.
Figure 3:
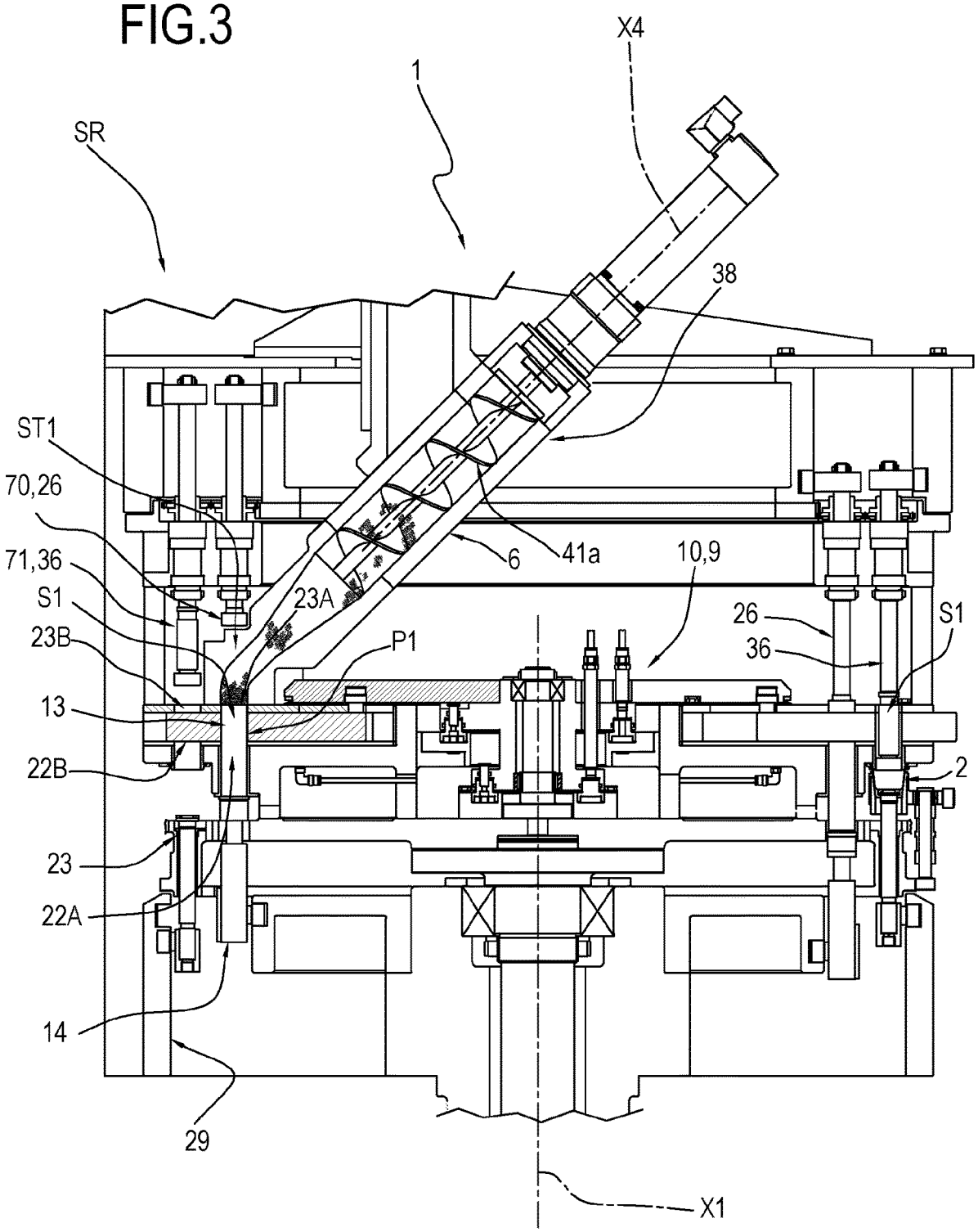
FIG. 3 is a side view of the release unit of the machine of FIG. 1.
Figure 4:
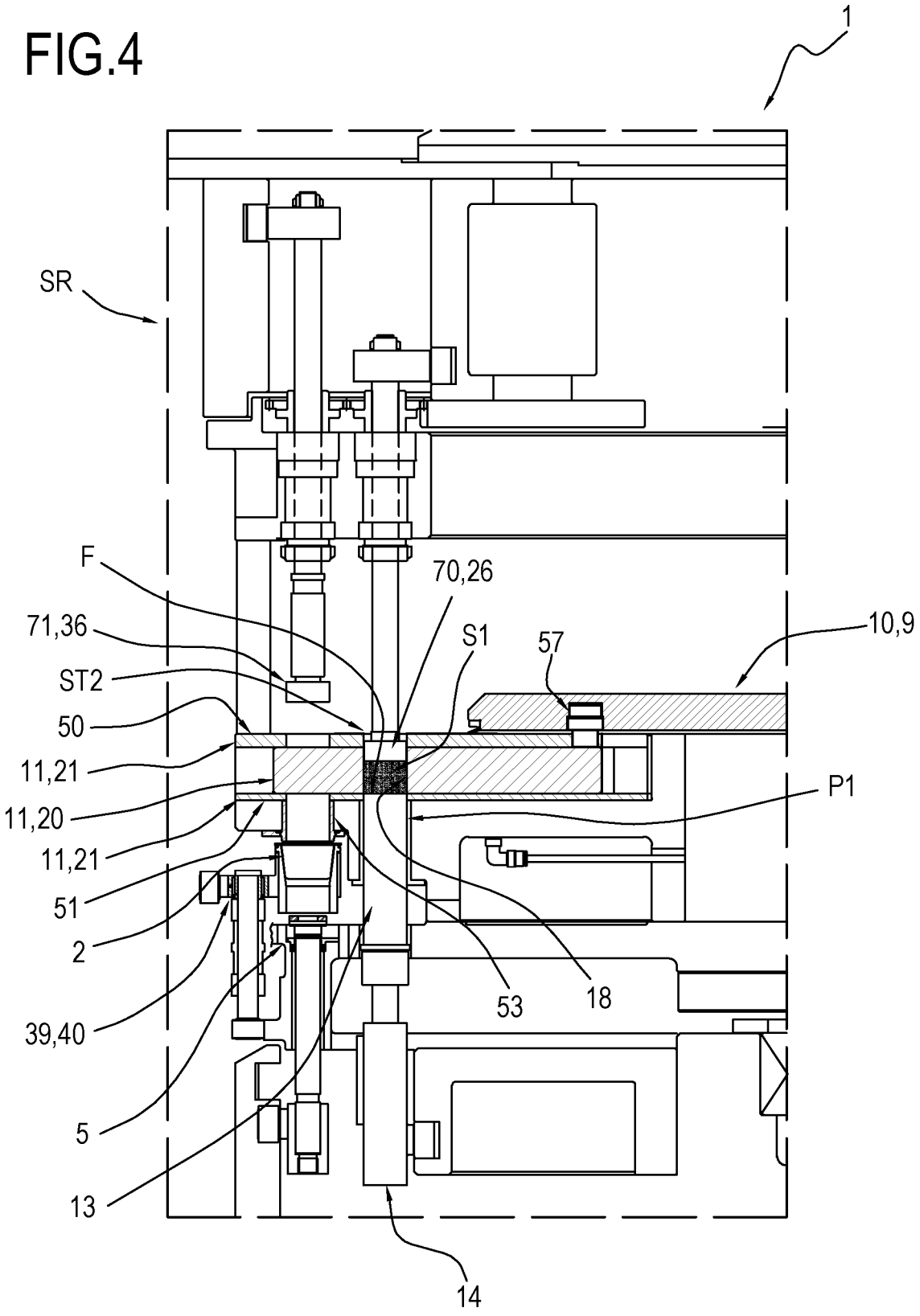
FIGS. 4 to 6 show corresponding side views partly in cross section of the release unit of FIG. 3 according to different operating steps.
Figure 5:
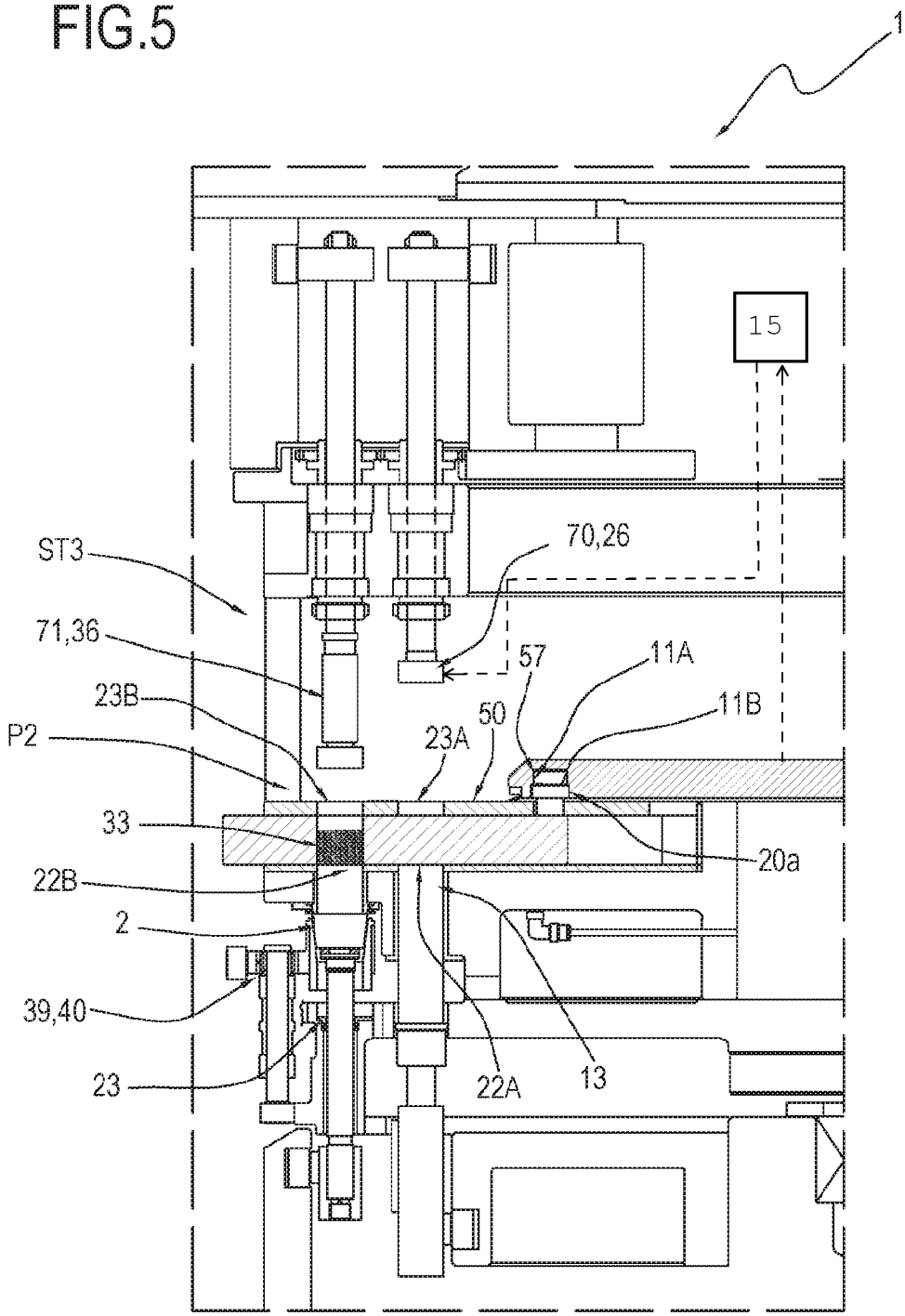
Figure 6:
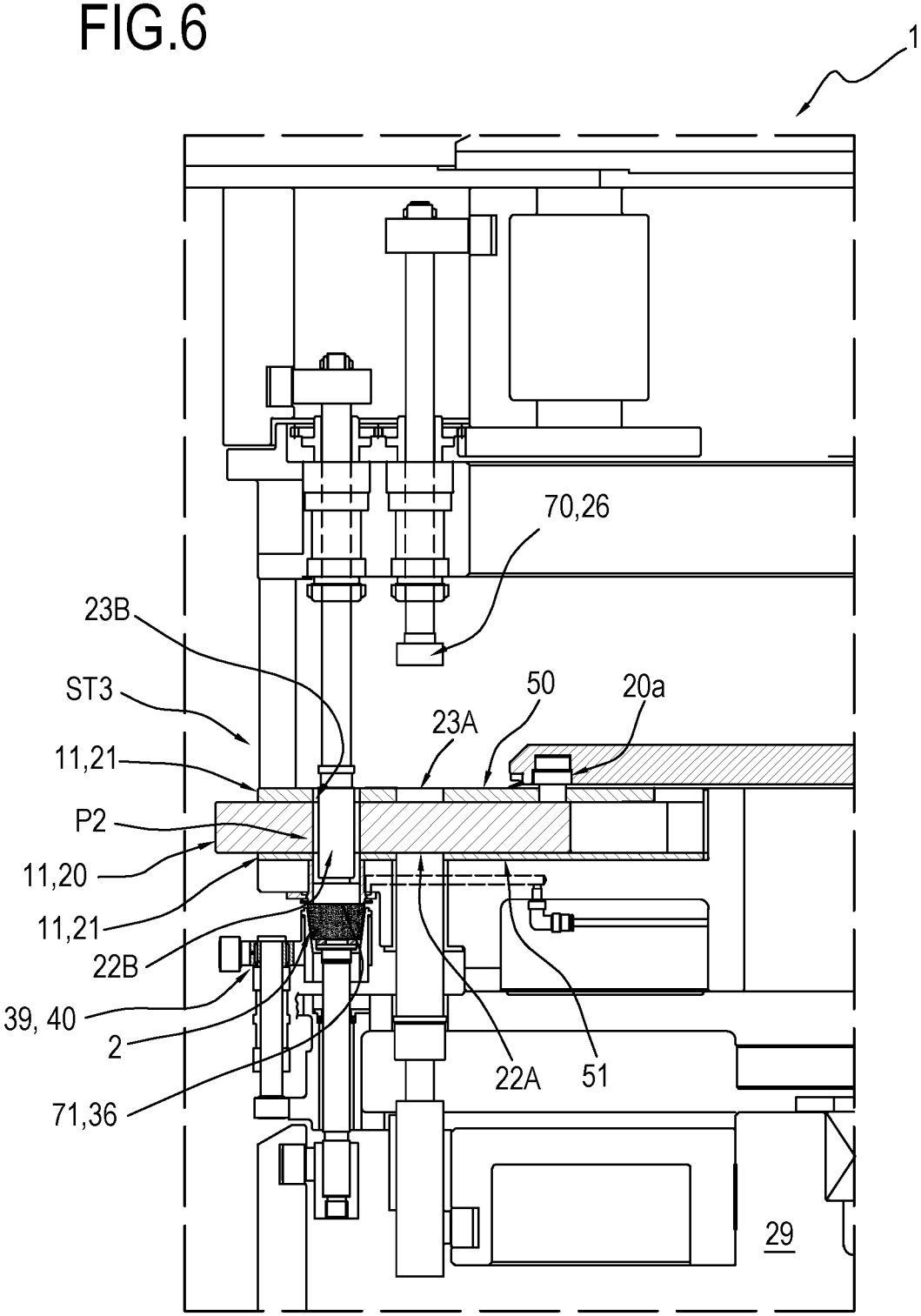
Figure 7:
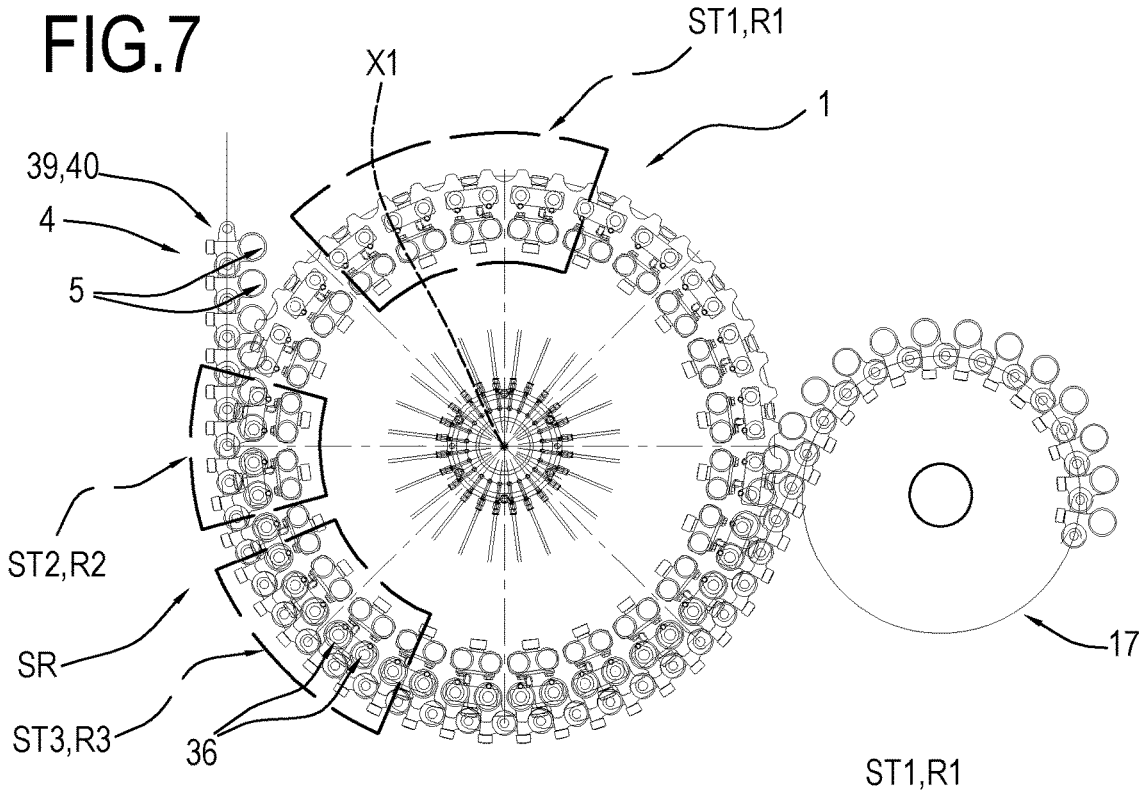
FIGS. 7 and 8 are plan views of a detail of the release unit of the machine of FIG. 1.
Figure 8:
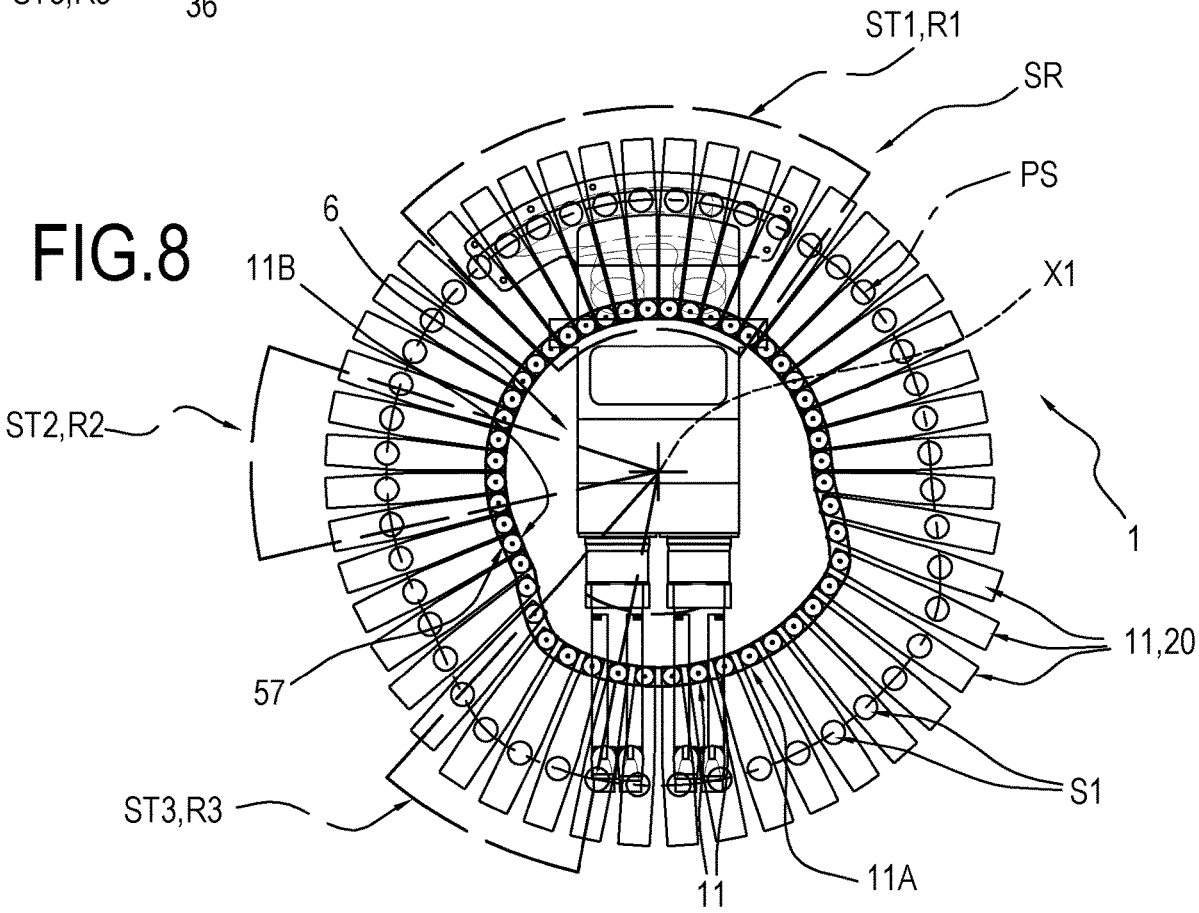

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

It should also be noted that this type of capsule 3 may also comprise one or more filtering or product retaining elements (not illustrated here for simplicity reasons).

In the capsule 3 illustrated in FIG. 2, the rigid, cup-shaped body 2 defines the container to be filled with a dose 33 of product.

Other types of capsules may be filled with the release unit 1 according to the invention, for example capsules wherein the dose 33 of product is contained in, and retained by, a filtering element connected to the rigid body, wherein the rigid body can be closed at the bottom, or open.

In other words, in capsules not illustrated, a filtering element may contain and retain the dose 33 of product, forming the container in combination with the rigid body with which it is coupled.

It should also be noted that, according to yet another embodiment not illustrated, the release unit 1 may release product on one or more strips of filter material (preferably paper-based), defining portions of single-use pods.

The one or more strips of filter material therefore form the above-mentioned container 2.

In the following description, reference will be made to the rigid, cup-shaped body 2 as the container, but it is understood that the invention can be made with reference to:

- capsules wherein the containing element is formed by a filtering element (or other components of the capsule designed to contain a dose 33 of product) and by the respective rigid body to which it is connected;
- or pods consisting of one or more lengths of filter material containing the dose of product.

The unit 1 for releasing product for extraction or infusion beverages in containers 2 forming single-use capsules 3, comprises according to this invention:

- at least one containing seat S1 to contain a dose 33 of product having side walls;
- a device 6 for feeding the product in the containing seat S1 for defining the dose 33 of product;
- a device 70 for compacting the dose 33 of product, acting on the dose 33 housed in the containing seat S1, for compressing the dose 33;
- a line 4 for transporting the containers 2;
- a device 10 for moving the at least one first seat S1 along a closed path PS;
- a device 71 for ejecting the dose from the containing seat S1, acting on the dose 33 housed in the containing seat S1 for causing a controlled escape to the outside of the containing seat S1;
- a unit 15 for controlling and operating the compacting device 70 and ejection device 71.

As described in more detail below, the control and operating unit 15 is configured in such a way as to activate the compacting device 70 with a force such as to compress the dose 33 of product to make the dose 33 coherent and induce a stable coupling, in an operating condition of the release unit 1, of the dose 33 with the side walls of the containing seat S1. This coupling prevents, in the operation condition of the release unit 1, the escape of product from the containing seat S1 in the absence of mechanical actions for pushing on the dose, that is, in the absence of movements of a mechanical pushing element acting on the dose.

In other words, in the absence of a mechanical element which comes into contact with and directly pushes the dose 33 outside the containing seat S1, the coupling between dose 33 and containing seat S1 and the coherence given to the product of the dose 33 is such that, in the operating condition of the release unit 1, the dose 33 of product (entirely or partly) not will escape from the containing seat S1.

It should be noted that the expression "operating condition" means the set of conditions in which the release unit 1 operates in use, such as, for example, the conditions of the product (humidity, consistency, temperature, grain size, elasticity, etc.) and the speed and trajectories of movement of the containing seat S1.

Preferably, the control and operating unit 15 is configured to operate the compacting device 70 to apply a compression force on the dose 33 of product which generates a pressure of between approximately 50,000 and approximately 200,000 Pa (that is, between approximately 0.5 Atm and approximately 2 Atm).

According to one aspect, the control and operating unit 15 is configured to receive a signal representing the speed of movement of the at least one containing seat S1, indicating the operating condition of the release unit 1. According to this aspect, the control and operating unit 15 is configured to control the compacting device 70 in such a way as to adjust the compressive force at least as a function of the signal representing the speed of movement of the at least one containing seat S1.

According to this aspect, the compressive force of the dose inside the containing seat S1 is constant or increases with the increase in the speed of movement of the containing seat S1.

More specifically, preferably, starting from a predetermined value of the speed of movement of the containing seat S1, the compressive force is constant until exceeding a predetermined speed differential, beyond which it undergoes an increase.

According to this aspect, preferably, the compressive force as a function of the speed has a "stepped" trend.

According to yet another aspect, which can be combined, or not, with the aspect described immediately above, the control and operating unit 15 is configured to receive one or more signals representing the physical/chemical features of the product (for example, humidity, consistency, temperature, grain size, elasticity) indicative of the above-mentioned operating condition of the release unit 1.

According to this aspect, the control and operating unit 15 is configured to control the compacting device 70 in such a way as to adjust the compressive force of the dose in the containing seat S1 at least as a function of one or more signals representing the chemical/physical features of the product.

Advantageously, according to this aspect, the control and operating unit 15 controls the compacting device 70 in such a way as to adjust the compressive force of the dose in the containing seat S1 as a function of one or more signals representing the humidity and/or a grain size and/or temperature and/or elasticity and/or consistency of the product forming the dose 33.

For example, moister products may be compressed with a compressive force less than that of less moist products.

With reference to the movement of the containing seat S1, attention is drawn to the following.

Preferably, in a first embodiment, the closed path PS for movement of the containing seat S1 lies on a horizontal plane.

Figure 9:
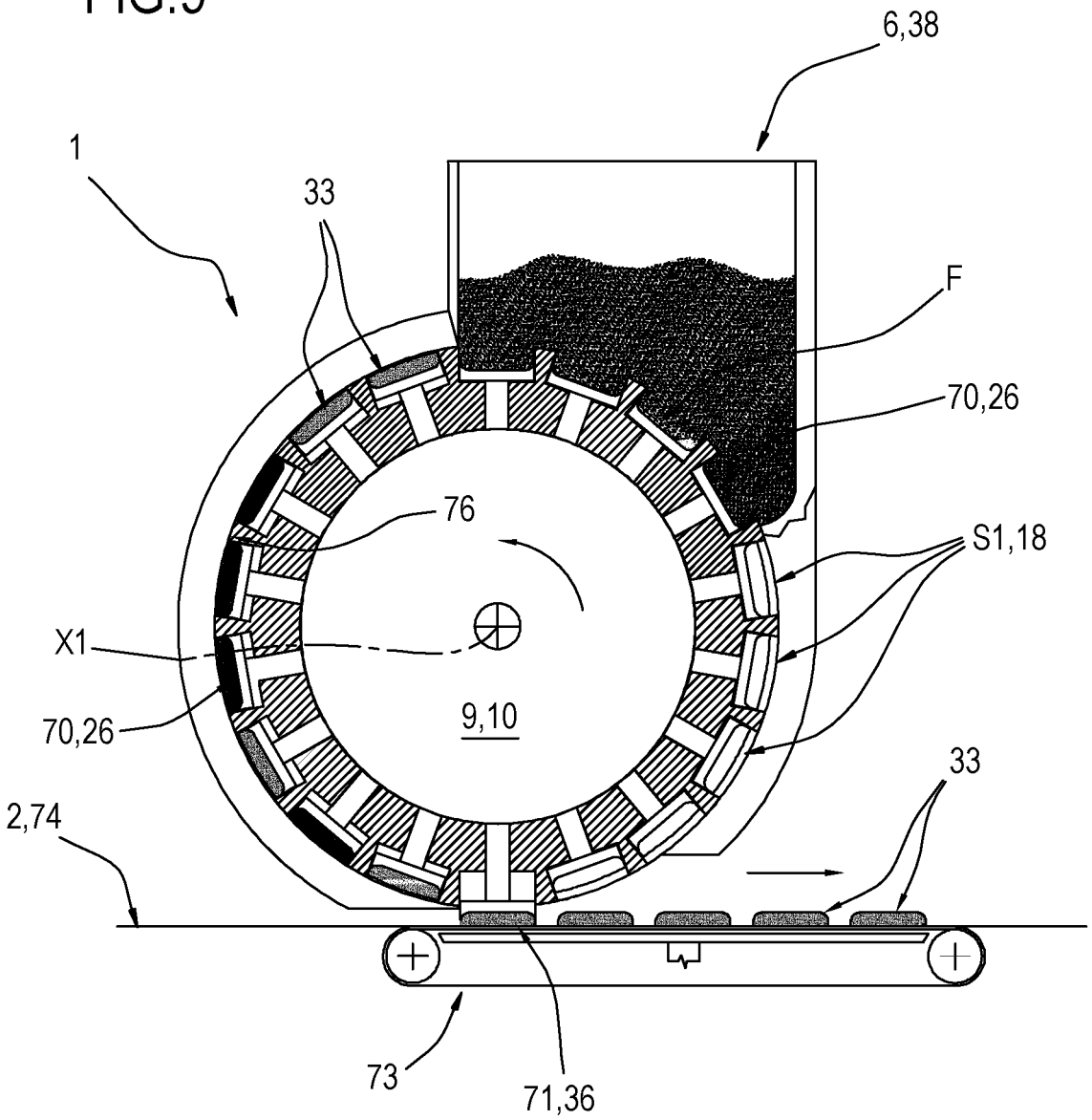
FIG. 9 is a schematic view of a further embodiment of the release unit of the machine of FIG. 1.

Alternatively, in a second embodiment illustrated in FIG. 9, the closed movement path PS lies on a vertical plane.

It should be noted that, preferably, the movement device 10 is designed to move the at least one containing seat S1 comprises a first element 9 rotating about a first axis X1 of rotation, which supports the at least one containing seat S1 in rotation along a closed path PS about the first axis X1 of rotation.

Preferably, in one embodiment, the closed path PS is a circular path.

Still more generally speaking, preferably, the closed path PS is a curvilinear path.

Preferably, the containing seat S1 is moved along the closed path PS according to a predetermined direction of movement.

It should be noted that, preferably, but not necessarily, the direction of movement of the containing seat S1 along the closed path PS is never inverted during a complete movement of the seat S1 along the closed path PS.

In other words, for each seat S1, there is no inversion of the motion along the closed path PS.

It should be noted that the axis X1 of rotation, in the embodiment illustrated, is vertical.

Alternatively, in the embodiment illustrated in FIG. 9, the axis X1 of rotation is horizontal.

Preferably, the release unit 1 comprises a plurality of containing seats S1, arranged radially on the first rotary element 9 to be carried in rotation by the first rotary element 9.

It should be noted that the containing seats S1 are preferably positioned along an arc of a circle of the rotary element 9, even more preferably they are positioned along the entire circumference having as the centre a point of the first axis X1.

Still more preferably, the first containing seats S1 are angularly equispaced from each other along a circumference having as the centre a point of the first axis X1.

It should also be noted that each containing seat S1 is moved cyclically in a region in which it receives the product from the feed device 6 and in a region in which the product is released—by the pushing action of the ejection device 71—from the containing seat S1.

Again with reference to the containing seat S1 (hereinafter also referred to as "first seat"), it should be noted that preferably the first seat is defined by a cavity 18 having side walls and a movable bottom wall F.

According to this aspect, preferably, the compacting device 70 of the release unit 1 comprises, for each containing seat S1:

a first piston 13 which is movable between a lower position and an upper position and forming the above-mentioned movable bottom wall F of the containing seat S1;

means 14 for moving the first piston 13 for moving the first piston 13 between the lower and upper positions in such a way as to adjust the volume inside the containing seat S1.

It should be noted that each first piston 13 is rotated by the rotary element 9.

More specifically, the first pistons 13 are positioned in a predetermined radial position relative to the axis X1 of the rotary element 9.

Advantageously, the release unit 1 comprises, for each containing seat S1, a compression element 26 movable between a non-operating position and an operating position where it compresses the dose 33 inside the containing seat S1, in conjunction with the first piston 13, in such a way as to compact the dose 33.

Preferably, the compression of the dose 33 occurs along a compression direction and determines a radial flattening of the dose 33 against the side walls of the containing seat S1.

Preferably, the compression element 26 is movable vertically between the non-operating position and the operating position. The compression element 26 is connected to (carried by) the rotary element 9 of the filling station SR. Preferably, the unit 1 comprises a compression element 26 for each containing seat S1.

In an alternative embodiment not illustrated, the compression element 26 may be omitted and replaced by a fixed contact element, for example a plate, against which the dose 33 of product is pushed by the compression action of the first piston 13.

According to another aspect, the ejection device 71 comprises at least one movable ejection element 36 to make contact with the dose 33 inside the at least one containing seat S1, and eject it outside the containing seat S1 to release it.

It should be noted that, in this way, the ejection of the dose from the containing seat S1 occurs by a pushing action (positive action) of the movable ejection element 36.

In the absence of the pushing of the movable ejection element 36, due to the pressure previously applied by the compacting device 70 on the dose 33 which is therefore consistent and stably coupled to the containing seat S1, in operating conditions of the release unit 1, the dose 33 (entirely or partly) not would escape from the containing seat S1.

Advantageously, the control and operating unit 15 is configured to control the movable ejection element 36 so as to apply on the dose 33 a thrust to allow its release to the outside of the containing seat S1.

Advantageously, the control and operating unit 15 is configured to control the movable ejection element 36 so as to push the dose 33 outside the containing seat S1.

According to one aspect preferred embodiment of the invention, the control and operating unit 15 controls the movable ejection element 36 in such a way as to push the dose 33 outside the containing seat S1 with an ejection speed which is less than the speed of dropping by gravity of the dose 33. The reduced ejection speed, in particular less than the speed of dropping by gravity, makes it possible to minimise the turbulence of the air leaving the container 2, and therefore minimise the escape of product from the container 2.

Preferably, the unit 1 comprises a plurality of ejection elements 36, each of which is associated with a corresponding containing seat S1 to be operatively acting on the containing seat S1.

The use of the release unit 1 is briefly described below, from which the advantages of the invention may be inferred.

The feed device 6 is configured to release a predetermined quantity of product in the containing seat S1, in a predetermined release region.

It should be noted that the compression element 26 is activated after the product has been released into the containing seat S1.

The compression element 26, in the embodiment shown in FIGS. 3 to 8, comes into contact with the dose 33 of product, penetrating into the containing seat S1, for compressing the dose 33.

It should be noted that the product in the containing seat S1 is supported by the bottom F and contained inside the side walls of the containing seat S1.

For this reason, the action of the compression element 26 means that the product—confined and constrained in the containing seat S1 due to the presence of the bottom and the side walls—expands radially, making contact with and coupling with the side walls.

Further, following the compression action the product forming the dose 33 is coherent.

In the condition of compression, that is, once the dose has been compressed, the dose (entirely or partly) does not escape from the containing seat S1 even in the absence of the bottom F of the containing seat S1, unless a pushing action is applied on the dose.

For this reason, the bottom F of the containing seat S1 may be removed (for example, the piston 13 can be moved in such a way that the piston 13 no longer constitutes the above-mentioned bottom wall F) without causing any accidental escape of the product.

The compression applied on the dose 33 advantageously depends on the operating condition of the release unit 1, that is, on speed and trajectory of the containing seat S1, that is, the chemical/physical characteristics of the product processed and prevents escape in the operating condition of the release unit 1 of the entire dose 33, or parts of the dose 33, from the containing seat S1 in the absence of mechanical actions pushing the dose 33, that is, in the absence of a mechanical element which comes into contact with and pushes the dose 33 outside the containing seat S1.

According to this aspect, the containing seat S1 may be moved without there being any escape of the product up to a release position along the closed path PS in which the ejection of the dose 33 of product from the containing seat S1 is performed by means of the ejection device 71.

In this to the release position, the ejection device 71 operates on the containing seat S1, to apply a pushing action aimed at ejecting the product from the containing seat S1.

It should be noted that, according to the embodiment illustrated in the accompanying drawings, in the release position the containing seat S1 is without bottom F, so that the action of the ejection device 71 makes it possible to eject the dose 33 through the opening of the containing seat S1 which was previously closed by the movable bottom F.

Alternatively, in an embodiment illustrated in FIG. 9 (and described in more detail below), in the release position the bottom F applies a function of compacting and ejecting the dose so as to eject the dose through the opening opposite the movable bottom F.

For this reason, in this embodiment, the movable bottom F of the containing seat S1 defines the compacting device 70 and the ejection device 71.

It should be noted that this invention advantageously prevents, thanks to the compression of the dose up to a predetermined value, the escape of the product during movement of the containing seat S1 between the different processing stations; only a pushing action on the dose 33 allows the dose to be expelled from the containing seat S1.

In practice, the compression of the dose means that the dose becomes a coherent and compact block of product in the containing seat S1, adhered to the side walls of the containing seat S1 (due to the friction action between product and side walls of the seat).

Advantageously, in use, the unit 1 prevents the dispersion of product in the release unit 1, which is the cause of rapid wear and reduction in the reliability of the movable components of the machine, and soiling of the rigid body 2.

It should be noted that the release unit 1, according to this invention, is particularly simple in terms of construction and at the same time is extremely flexible, and can easily be adapted to different types of product and/or size of the components of the capsules or pods.

Also defined according to this invention is packaging machine 100 designed to package single-use capsules 3 for extraction or infusion beverages comprising a release unit 1 as described above; a line 4 for transporting containers 2; a station SA for feeding containing 2 of single-use capsules 3 in corresponding supporting seats 5 of a transport line 4; a station SC for closing the containers 2 with a respective piece of sealing sheet 34; and an outfeed station SU which picks up the capsules 3 from the supporting seats 5 of the transport line 4.

Some parts of the packaging machine 100, illustrated in the accompanying drawings, are described below.

It should be noted that the machine 100 comprises a line 4 for transporting (that is to say, moving) containers, that is to say, rigid, cup-shaped bodies 2.

The transport line 4 extends along a first movement path P and is provided with a plurality of seats 5 for supporting the rigid containers 2, arranged in succession along the first path P.

Preferably, the first movement path P is a closed path lying on a horizontal plane.

The supporting seats 5 are arranged one after another, not necessarily continuously.

In addition, the supporting seats 5 each have a corresponding vertical axis of extension.

It should be noted that the transport line 4 comprises a transport element 39 to which the supporting seats 5 are connected to be moved along the first path P.

It should be noted that the transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

It should be noted that at least one of the links comprises at least one supporting seat 5 with a vertical axis for corresponding rigid container 2 which can be positioned with the opening 31 facing upwards.

Preferably, but not necessarily, the movement means 17 rotate continuously about vertical axes to allow the transport element 39 to move continuously.

In the embodiment illustrated, the unit 1 comprises a device 11 for adjusting the position of the containing seat S1, configured for adjusting the position of the containing seat S1 along the closed path PS, between a position P1 for receiving the dose 33 and a position P2 for releasing the dose 33 inside a respective container (rigid body 2).

Moreover, the unit 1 comprises a substation ST1 for forming the dose 33 inside the at least one containing seat S1, in which the above-mentioned feed device 6 is positioned.

The release unit 1 also comprises a substation ST3 for releasing the dose of product from the at least one containing seat S1 positioned in the position P2 for releasing the dose to a container 2 (transported by the transport line 4).

It should be noted that the compacting device 70 operates in the path of the containing seat S1 between the forming substation ST1 for the release substation ST3.

It should be noted that the ejection device 71 operates at the release substation ST3.

The device 11 for adjusting the position is configured to place the at least one containing seat S1 in the position P1 for receiving at the substation ST1 for forming the dose and in the position P2 for releasing the dose at the substation ST3 for releasing the dose.

All the above-mentioned components forming part of the unit 1 and/or the machine 100 are described below in more detail, with particular reference to the accompanying drawings.

It should be noted that each containing seat S1 is moved by the first rotary element 9 in rotation so as to engage cyclically—during the rotation—the substations for forming ST1 and releasing ST3 the dose.

It should be noted that the device 11 for adjusting the position allows the containing seat S1 to be placed in the first position P1 for receiving at the forming substation ST1 and in the second position P2 for releasing at the substation ST3 for releasing the dose.

In the embodiment illustrated in the accompanying drawings, the containing seats S1 are supported by the first rotary element 9 in a radially movable fashion.

According to this aspect, the adjustment device 11 is configured to move the at least one containing seat S1 radially relative to the first axis X1 of rotation between the position P1 for receiving the dose and the position P2 for releasing the dose.

More specifically, the adjustment device 11 is configured to move the at least one containing seat S1 radially in a forward stroke from the position P1 for receiving the dose to the position P2 for releasing the dose and according to a return stroke from the position P2 for releasing the dose to the position P1 receiving the dose.

In the embodiment illustrated, the containing seat S1 is formed in an element 20 for containing the dose (preferably having an elongate shape).

Preferably, the containing seat S1 is a through seat, formed in the element 20 for containing the dose.

In other words, the containing seat S1 extends through between an upper face and a lower face of the containing element 20.

Preferably, the containing seat S1 has a cylindrical shape, that is, it has a circular cross section.

According to another aspect, the release unit 1 comprises an element 21 for housing the containing element 20, provided with upper openings 23A, 23B and lower openings 22A, 22B.

Preferably, the housing element 21 is fixed to the rotary element 9, in such a way as to be rotated by the rotary element without the position being modified.

In practice, the housing element 21 defines a housing cavity, inside of which the containing element 20 is movably inserted to be movable between the above-mentioned position P1 for receiving the dose and position P2 for releasing the dose.

The containing elements 21 and housing elements 20 are supported by the rotary element 9, so that the rotation of the rotary element 9 also determines the rotation of the these elements 20, 21.

The release unit 1 also comprises a track, or cam, 57 having side walls 11A, 11B facing each other. Preferably, the track 57 extends on a closed-loop path.

The element 20 for containing the dose is configured for engaging in the track 57, in such a way that the position of the element 20 for containing the dose along the closed path PS can be adjusted.

It should be noted that the track 57 is fixed relative to the frame 29 of the release unit 1, that is, it is not rotated as one with the rotary element 9.

In practice, it should be noted that the element 20 for containing the dose is equipped with a portion, or cam follower, 20*a* designed to be inserted in the track 57.

It should be noted that the portion 20*a* and the track 57 define, in combination, a cam device configured for adjusting the position of the containing seat S1 along the closed path PS.

It should also be noted that the containing element 20, the housing element 21 and the cam device 20*a*, 57 define the above-mentioned device 11 for adjusting the position of the containing seat S1 along the closed path PS.

It should also be noted that the housing element 21 comprises an upper wall 50, provided with a first upper opening 23A and a second upper opening 23B.

The first upper opening 23A is located in a position close to the axis X1, whilst the second upper opening 23B is located in a position far from the axis X1.

The housing element 21 also comprises a lower wall 51, provided with a first lower opening 22A and a second lower opening 22B.

The first lower opening 22A is located in a position close to the axis X1, whilst the second lower opening 22B is located in a position far from the axis X1.

Preferably, the first upper opening 23A is vertically superposed on the first lower opening 22A. Preferably, the second upper opening 23B is vertically superposed on the second lower opening 22B.

The first and second openings 22A, 22B, 23A, 23B, are in communication with the housing cavity defined by the housing element 21 and inside of which the containing element 20 can move radially.

The containing element 20, therefore the containing seat S1, is movable in such a way as to be positioned:

- in the first position P1 for receiving the dose 33, in a condition of vertical alignment with the first upper opening 23A and the first lower opening 22A, and
- in the second position P2 for receiving the dose 33, in a condition of vertical alignment with the second upper opening 23B and the second lower opening 22B.

In other words, when the containing seat S1 is positioned vertically aligned with the first upper openings 23A and lower openings 22A, the containing seat S1 is in the position P1 for receiving the dose, whilst when containing seat S1 is positioned vertically aligned with the second upper openings 23B and lower openings 22B the containing seat S1 is in the position P2 for releasing the dose 33.

It should also be noted that the release unit 1 further comprises a substation ST2 for compacting the dose, configured to compact the dose inside the containing seat S1.

The compacting device 70 operates at the compacting substation ST2.

The compacting substation ST2 is located along the closed path PS between the substation ST1 for forming the dose and the substation ST3 for releasing the dose.

Described below is the substation ST1 for forming the dose.

The substation ST1 for forming the dose is positioned in a region R1 for forming the dose.

At the substation ST1 for forming the dose there is the feed device 6, designed for releasing a predetermined quantity of product (defining the dose 33) inside the containing seat S1 positioned in the region R1 for forming the dose 33.

The feed device 6 according to a first embodiment comprises a hopper 38 (filled, in use, with product) having at the bottom an outlet for the product.

Preferably, the hopper 38 can house one or more screw feeders 41*a*, designed to be rotated for feeding the product inside the one or more containing seats S1.

With reference to the movement of the above-mentioned first piston 13 in the region R1 for forming the dose, the following should be noted.

Preferably, when the above-mentioned containing seat S1 is inside the region R1 for forming the dose, in particular at the infeed zone, the first piston 13 associated with the containing seat S1 is positioned in a predetermined position (vertical) wherein it defines a predetermined space in the containing seat S1.

According to the invention, by varying the position (vertical) of the first piston 13 by means of the movement means 14 in the region R1 for forming the dose it is possible to vary the quantity of product contained in the containing seats S1, or in other words, it is possible to vary the dose 33. Basically, the movement means 14 are designed to position the first piston 13 in a desired dosing position at an outfeed zone of the region R1 for forming the dose 33, for defining the dose 33.

Some aspects of the compacting device 70, with reference to the embodiment shown in FIGS. 3 to 8, are described below in more detail.

It should be noted that the compression element 26 is positioned in the lowered operating position at the substation ST2 for compacting the dose. The compression element 26 is positioned above the first piston 13.

In practice, the compression element 26 is positioned relative to the rotary element 9 in a position such that in the lowered operating position it can be inserted through the first upper opening 23A of the upper wall 50 of the containing element 20.

On the other hand, the first piston 13 is positioned relative to the rotary element 9 in a position such that the first piston 13 can pass through the first lower opening 22A of the lower wall 51 of the containing element 20.

It should be noted that the lower face of the compression element 26 defines, at the compacting region R2, an upper contact element of the dose 33 positioned inside the first containing S1, so as to compact/compress the product.

In other words, the dose 33 is compressed between the first piston 13 and the compression element 26, by the action of the compression applied by the latter.

Alternatively, once the dose 33 is formed, the first piston 13 can be moved to compact the product and the compression element 26 acts as a fixed contact element for the first piston 13. In other words, the dose 33 may be compacted by operating one, or the other, or both between the first piston 13 and the compression element 26.

Advantageously, there may be devices to prevent overloading, such as, for example, springs, or pneumatic elements, connected to the first piston 13 and/or the compression element 26.

The ejection element 36 is located above a piston 23 for lifting the container 2.

It should be noted that the unit 1 also comprises (in the embodiment shown in FIGS. 3 to 8) a piston 23 for lifting the container 2, which is movable at the substation ST3 for releasing the dose between a lower position and an upper position for lifting the container 2.

Preferably, the release unit 1 comprises a lifting piston 23 for each containing seat St preferably, each piston 23 is rotated by the rotary element 9 as one with the first seat S1.

In practice, the ejection element 36 is positioned relative to the housing element 21 in a position such that in the lowered operating position the ejection element 36 can be inserted through the second upper opening 23B of the upper wall 50.

It should be noted that the lower face of the ejection element 36 abuts at the top, at the region R3 for releasing the dose, the dose 33 positioned inside the containing seat S1, in such a way as to push the dose 33 towards the outside of the containing seat S1 to release the dose inside the container 2 lifted by the lifting piston 23.

Advantageously, the ejection element 36 pushes the dose 33 when the container 2 is lifted by the lifting piston 23, and, therefore, the container 2 is positioned close to the containing seat S1, so as to minimise the dispersion of product outside the container.

In alternative embodiments not illustrated, the compression element 26 can define the ejection element 36.

With reference to the compression element(s) 26, the ejection elements 36, the first piston 13 and the piston lifting 23, it should be noted that the above-mentioned elements/devices 26, 36 and pistons 13, 23 are supported (vertically movable) by the rotary element 9, that is to say, they are positioned in a predetermined radial position.

The compression element(s) 26, ejection device(s) 36, first piston(s) 13 and the lifting piston(s) 23 are movable vertically, as described above.

FIG. 9 shows a further embodiment wherein the release unit 1 comprises a rotary element 9, designed to rotate about a horizontal axis X1 of rotation.

The rotary element 9 is provided with a plurality of containing seats S1 which are equipped with a movable bottom F.

The movable bottom F defines the ejection device 71 and also the compacting device 70.

In other words, in this embodiment, the bottom F acts as a compression element 26 and as an ejection element 36 for the dose.

According to this embodiment, preferably, the machine is equipped with a device 73 for conveying a web or strip 74 of filter material (preferably made of paper).

Advantageously, the movable bottom F is further rotational about an axis perpendicular to the axis X1 of rotation to favour detachment of the dose 33 from the movable bottom F.

The web or strip 74 of filter material is designed to receive the dose released from the containing seat S1 and defines the container 2.

Lengths of the web or strip 74 of filtering material will constitute corresponding pods.

It should be noted that, after receiving the product from the hopper 38, the containing seat S1 is moved to an angular sector wherein there is an outer contact 76 (fixed relative to the frame), designed to close the top of the infeed of the containing seat S1 (opposite the bottom F).

In this angular sector the compression element 26 is moved radially outwards in such a way as to compact the dose, delimited between the contact element 76 and the compression element 26, with a compressive force which generates a pressure of between approximately 50,000 and approximately 200,000 Pa (that is between approximately 0.5 Atm and approximately 2 Atm), such as to cause a stable coupling, in an operating condition of the release unit 1, of the dose 33 with the side walls of the containing seat S1.

Subsequently, the containing seat S1 is moved to an angular sector for releasing the product where the contact element 76 is interrupted and wherein the compression element 26 is moved radially towards the outside so as to eject the dose 33 to the outside of the containing seat S1 (and release it preferably on the underlying container 2).

In the absence of radial movement of the compression element 26, due to the compaction of the dose 33 with a force such as to cause the stable coupling of the dose with the side walls of the containing seat S1, the dose 33 of product would begin to escape from the containing seat S1 in an incoherent manner as soon as the contact element 76 is interrupted, settling on a vast area of the underlying strip 74.

It should be noted that in the embodiment of FIG. 9, the dose 33 is subjected to a centrifugal force which tends to make the dose escape from the containing seat S1, so that, relative to the embodiment shown in FIGS. 3 to 8, the compacting pressure necessary so that the dose 33 does not escape from the respective containing seat S1 is higher, for the same operating speeds, chemical/physical characteristics of the product and size of the dose 33.

According to this invention, a method is also defined for releasing product for extraction or infusion beverages into containers 2 forming single-use capsules 3, or pods.

The method comprises the following steps:

moving a succession of containers 2 along a first movement path P;

moving at least one containing seat S1 designed to contain a dose 33 of product along a closed path PS according to a movement speed;

releasing a dose 33 of product in the containing seat S1 of a release unit;

compressing the dose 33 of product in the respective containing seat S1 with a compressive force such as to compact and make coherent the product and cause a stable coupling of the dose 33 with the side walls of the containing seats S1 which prevents, in the operating conditions of the release unit and in the absence of mechanical actions for pushing on the dose, that is in the absence of movements of a pushing element acting on the dose, the escape of the dose from the containing seat S1;

exerting a mechanical action for pushing on the dose in a predetermined release zone, in such a way as to cause a controlled escape of the dose from the containing seat S1.

In other words, the method comprises compressing the dose 33 of product in the respective containing seat S1 with a compressive force such as to compact and make coherent the product and cause a stable coupling of the dose 33 with the side walls of the containing seat S1 such that, in the operating condition of the release unit 1 and in the absence of a mechanical element which comes into contact with and directly pushes the dose 33 outside the containing seat S1, the dose 33 of product (entirely or partly) not will escape from the containing seat S1.

Advantageously, the method comprises exerting a mechanical action for pushing on the dose at a predetermined release zone, in such a way as to cause a controlled escape of the dose from the containing seat S1 with a reduced ejection speed, in particular less than the speed of dropping by gravity of the dose 33.

In a preferred embodiment, the method also comprises a step of adjusting the compressive force as a function of the operating condition of the release unit.

According to another aspect, the step of moving at least one containing seat S1 along a closed path PS comprises a step of moving the containing seat S1 along a curvilinear path according to a predetermined direction of movement.

Advantageously, in this preferred embodiment, the method comprises a step of adjusting the compressive force as a function of the speed of movement of the at least one containing seat S1.

Advantageously, the method comprises varying the compressive force as a function of the chemical/physical characteristics of the product of the dose 33.

Advantageously, the method comprises a step of varying the compressive force as a function of the humidity and/or a grain size and/or temperature and/or elasticity and/or consistency of the product forming the dose 33.

The invention claimed is:

1. A release unit for releasing product for extraction or infusion beverages in containers of single-use capsules or pods, comprising:

at least one containing seat configured to contain a predetermined dose of product and having side walls;

a feed device configured to feed the product in the at least one containing seat for defining the predetermined dose of product;

a compacting device configured to compact the dose of product in the at least one containing seat;

a movement device configured to move the at least one containing seat along a closed path between a position for receiving the dose and a position for releasing the dose;

an ejection device configured to eject the dose out from the at least one containing seat; and a control and operating unit configured to control and operate the compacting device and the ejection device, the control and operating unit being configured to control the compacting device to exert a compression force on the dose of product to make the dose of product coherent and cause a coupling of the dose with the side walls of the at least one containing seat to prevent, in the operating condition of the release unit, the dose from escaping from the at least one containing seat wherein the movement device is configured to move the at least one containing seat and comprises a rotary element rotating about a first axis of rotation, which supports the at least one containing seat in rotation along the closed path about the first axis of rotation, wherein the at least one containing seat is radially arranged on the rotary element, wherein the control and operating unit is configured to control the compacting device to adjust the compression force exercised by the compacting device on the dose inside the at least one containing seat in response to a speed of movement of the at least one containing seat, wherein the control and operating unit is configured to move the compacting device farther into the at least one containing seat toward the dose to increase the compression force exercised on the dose by the compacting device when the speed of movement of the at least one containing seat increases, the compression force inside the at least one containing seat being constant or increasing when the speed of movement of the at least one containing seat increases.

2. The release unit according to claim 1, wherein the control and operating unit is configured to operate the compacting device to apply a compression force on the dose of product which generates a pressure of between approximately 50,000 and approximately 200,000 Pa.

3. The release unit according to claim 1, wherein the control and operating unit is configured to control and operate the ejection device to eject the dose out from the at least one containing seat at an ejection speed which is less than the speed of dropping by gravity of the dose from the at least one containing seat.

4. The release unit according to claim 1, wherein the control and operating unit is configured to control the compacting device to adjust the compression force on the dose inside the at least one first containing seat further at least as a function of chemical/physical characteristics of the product.

5. The release unit according to claim 1, wherein the closed path lies on a horizontal plane.

6. The release unit according to claim 1, wherein the closed path lies on a vertical plane.

7. The release unit according to claim 1, wherein the closed path is a circular path.

8. The release unit according to claim 1, wherein the first axis of rotation is vertical.

9. The release unit according to claim 1, wherein the at least one containing seat is defined by a cavity having side walls and a movable bottom wall.

10. The release unit according to claim 9, comprising, for each containing seat:

a first piston which is movable between a lower position and an upper position and forming the movable bottom wall of the at least one containing seat;

movement means for moving the first piston between the lower and upper positions in such a way as to adjust an internal volume of the at least one containing seat.

11. The release unit according to claim 1, wherein the compacting device comprises at least one compression element movable between a non-operating position and an operating position wherein it compresses the dose inside the at least one containing seat.

12. The release unit according to claim 11, wherein the compression element is movable vertically between the non-operating position and the operating position.

13. The release unit according to claim 11, comprising a compression element for each containing seat.

14. The release unit according to claim 1, wherein the ejection device comprises at least one movable ejection element to make contact with the dose inside the at least one containing seat and eject the dose outside the at least one containing seat.

15. The release unit according to claim 14, comprising a plurality of ejection elements, each of the ejection elements being associated with a containing seat.

16. A release unit according to claim 1, wherein the closed path is a curvilinear path and the containing seat is moved according to a predetermined direction of movement.

17. A method for releasing product for extraction or infusion beverages in containers of single-use capsules or pods, wherein it comprises the following steps:

moving a succession of containers along a first movement path;

moving at least one containing seat designed to contain a dose of product along a closed path between a position for receiving the dose and a position for releasing the dose according to a movement speed using a movement device that is configured to move the at least one containing seat and comprises a rotary element rotating about a first axis of rotation, which supports the at least one containing seat in rotation along the closed path about the first axis of rotation;

releasing a dose of product in the at least one containing seat of a release unit;

pressing the dose of product in the at least one containing seat using a compacting device by a control and operating unit which operates the compression device with a compressive force such as to compact and make coherent the product and cause a coupling of the dose with side walls of the at least one containing seat which prevents, in the operating condition of the release unit, the escape of the dose from the at least one containing seat; and exerting a mechanical action of pushing on the dose in a predetermined release zone, in such a way as to cause a controlled escape of the dose from the at least one containing seat, wherein an ejection device is used to eject the dose out from the at least one containing seat, and wherein the control and operating unit controls the compacting device to adjust the compression force exercised by the compacting device on the dose inside the at least one containing seat in response to a speed of movement of the at least one containing seat, wherein the control and operating unit is configured to move the compacting device farther into the at least one containing seat toward the dose to increase the compression force exercised on the dose by the compacting device when the speed of movement of the at least one containing seat increases, the compression force inside the at least one containing seat being constant or increasing when the speed of movement of the at least one containing seat increases.

18. The method according to claim 17, wherein the step of applying a mechanical action of pushing on the dose comprises causing an escape of the dose from the at least one containing seat with an ejection speed which is less than the speed of dropping by gravity of the dose from the at least one containing seat.

19. The method according to claim 17, comprising a step of varying the compressive force as a function of the speed of movement of the at least one containing seat.

20. The method according to claim 17, wherein the control and operating unit adjusts the compressive force further as a function of at least one of humidity and particle size of the product of the dose.

21. The method according to claim 17, wherein the step of moving at least one containing seat along a closed path comprises a step of moving the containing seat along a closed curvilinear path according to a predetermined direction of movement.

22. A release unit for releasing product for extraction or infusion beverages in containers of single-use capsules or pods, comprising:

at least one containing seat configured to contain a predetermined dose of product and having side walls;

a feed device configured to feed the product in the at least one containing seat for defining the predetermined dose of product;

a compacting device configured to compact the dose of product in the at least one containing seat;

a movement device configured to move the at least one containing seat along a closed path between a position for receiving the dose and a position for releasing the dose;

an ejection device designed configured to eject the dose out from the at least one containing seat; and a control and operating unit configured to control and operate the compacting device and the ejection device, the control and operating unit being configured to control the compacting device to exert a compression force on the dose of product to make the dose of product coherent and cause a coupling of the dose with the side walls of the at least one containing seat to prevent, in the operating condition of the release unit, the dose from escaping from the at least one containing seat, wherein the movement device is configured to move the at least one containing seat and comprises a rotary element rotating about a first axis of rotation which supports radially arranged the at least one containing seat in rotation along the closed path about the first axis of rotation, and wherein the control and operating unit is configured to receive a signal from the rotary element representing a speed of movement of the at least one containing seat, and wherein the control and operating unit is configured to control the compacting device to adjust the compression force exercised by the compacting device on the dose inside the at least one containing seat in response to the signal representing the speed of movement of the at least one containing seat, wherein the control and operating unit is configured to move the compacting device farther into the at least one containing seat toward the dose to increase the compression force exercised on the dose by the compacting device when the speed of movement of the at least one containing seat increases, the compression force inside the at least one containing seat being constant or increasing when the speed of movement of the at least one containing seat increases.

* * * * *